United States Patent [19]

Gross

[11] 4,112,576

[45] Sep. 12, 1978

[54] METHOD OF MAKING A SWITCH

[76] Inventor: Harry Robert Gross, 127 Carpenter St., West Branch, Mich. 48661

[21] Appl. No.: 632,405

[22] Filed: Nov. 17, 1975

[51] Int. Cl.[2] ..... H01H 11/06

[52] U.S. Cl. ..... 29/602 R; 29/622; 29/630 B; 264/264; 264/272; 264/276; 264/277

[58] Field of Search ..... 29/602 R, 622, 630 B; 335/126, 131; 264/272, 264, 275, 276, 277

[56] References Cited

U.S. PATENT DOCUMENTS

| | | | |
|---|---|---|---|
| 3,210,453 | 10/1965 | Smith | 264/276 X |
| 3,263,306 | 8/1966 | Chapin et al. | 29/622 |
| 3,361,997 | 1/1968 | Freeman, Jr. | 335/126 |
| 3,387,076 | 6/1968 | Murooka | 264/276 |
| 3,798,763 | 3/1974 | Deltoer | 29/622 X |
| 3,978,439 | 8/1976 | Thomson | 335/131 |

*Primary Examiner*—Carl E. Hall

*Attorney, Agent, or Firm*—Barnes, Kisselle, Raisch & Choate

[57] ABSTRACT

A solenoid and electric terminal heads are embedded in plastic by injection molding. Die faces accurately position and orient contact surfaces on the heads relative to the solenoid and contacts on the solenoid plunger, eliminating subsequent machining. The solenoid windings and lead wires are encapsulated by plastic injected in the molding process through openings in the coil casing. Portions of the lead wires outside of the casing and contact posts connected thereto are also embedded in the plastic. Injection molded walls guide axial movement of a rectangular contact member with the plunger and prevent its rotation out of alignment with the terminal heads. A fibrous washer compresses axially under the die force to compensate for cumulative axial tolerances of the solenoid and terminal heads for accurately positioning the bottom of the plunger opening relative to the contact surfaces on the terminal heads. Engagement of the plastic with the terminals and contact posts provides moisture-proof seals which cooperate with a plastic cap welded to the molded plastic to provide a moisture-proof housing.

45 Claims, 19 Drawing Figures

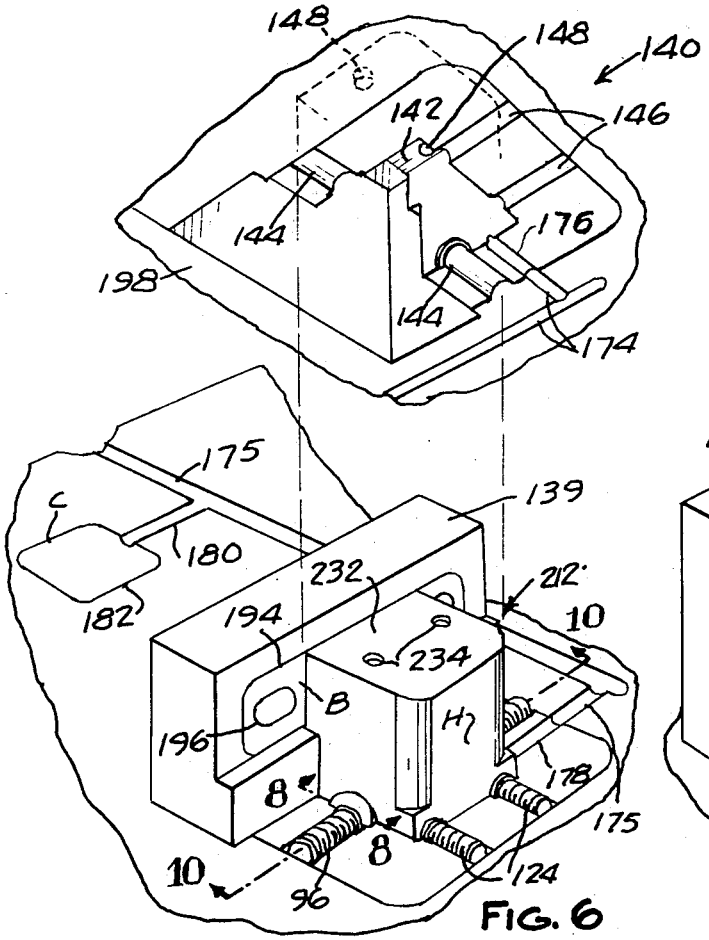
FIG. 6
FIG. 7
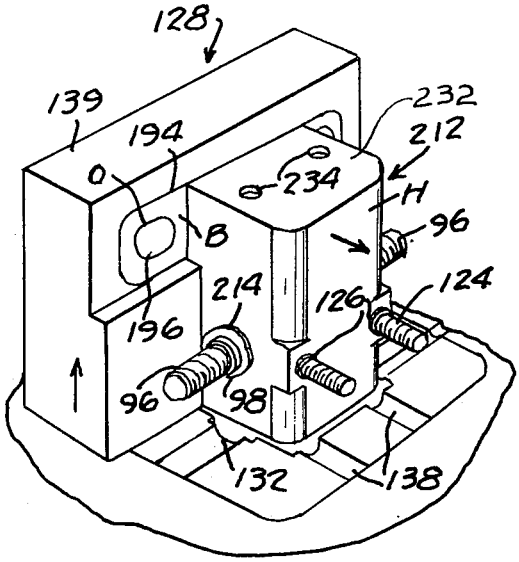
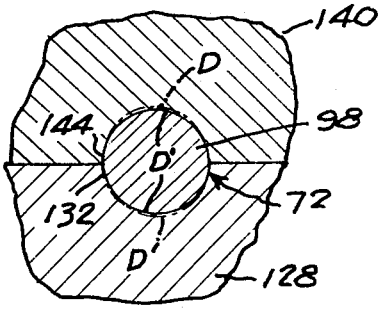
FIG. 8
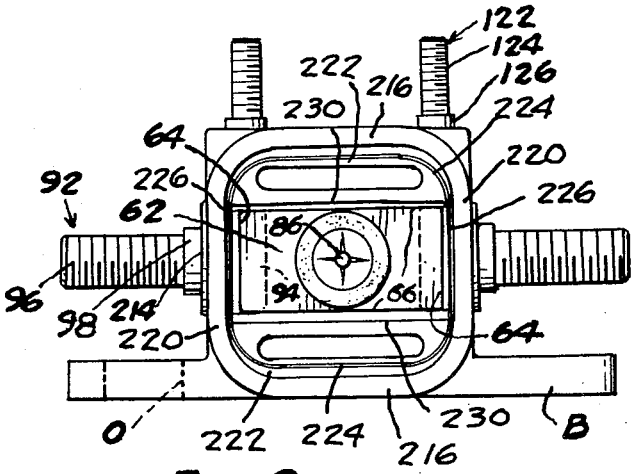
FIG. 9

FIG. 12
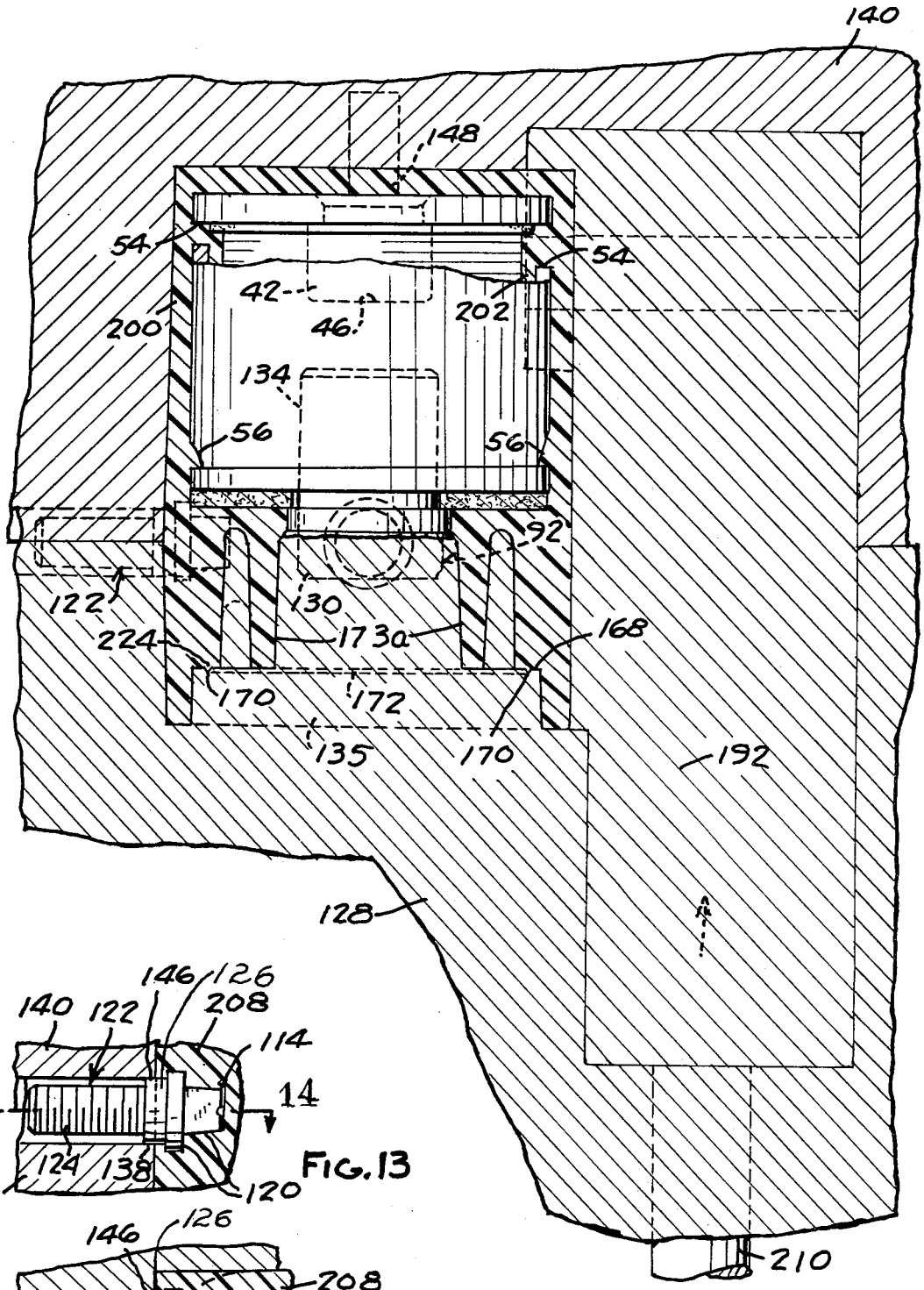
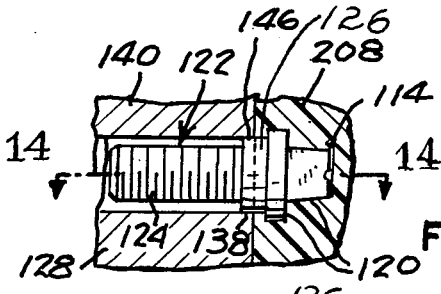
FIG. 13
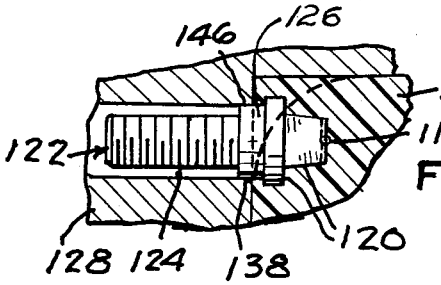
FIG. 14

METHOD OF MAKING A SWITCH

This invention relates to a method of making a switch and products of the method. The various features of the invention can be conveniently illustrated with respect to a solenoid actuated relay switch for the starter motor of an internal combustion engine and, accordingly, such a switch is selected for the present disclosure. A typical conventional switch of this type is disclosed in Terry U.S. Pat. No. 3,217,124.

Usually, a starter switch is subjected to engine vibrations whenever the engine is running, and over a period of time these vibrations tend to fatigue, loosen or otherwise damage the switch components. In conventional starter switches the measures taken to minimize the effects of the vibration have left something to be desired.

Conventional starter switches are made by providing a housing of an insulating material, such as a plastic, with holes formed therein to receive the starter motor terminals, contact posts for the solenoid lead wires and a rivet which secures together the bottom of the solenoid casing, the plastic housing and, where desired, a mounting bracket. The solenoid casing is inserted into the housing thus formed; a rivet inserted into the plunger opening within the solenoid coil is projected through aligned bottom openings in the solenoid casing and housing, through the mounting bracket opening and is then staked over.

The motor terminals and solenoid contact posts, which are in the form of bolts, are inserted outwardly through the preformed openings in the housing and nuts are run onto the bolts into tight engagement with the housing exterior. Fluent plastic potting material is applied over the top of the solenoid casing around its plunger opening which, when set, assists in securing the solenoid in position and is intended to provide a moisture-proof seal at the top of the solenoid. The conventional manufacturing procedure involves numerous operations and is thus relatively slow and costly.

The starter motor terminals have heads within the housing whose upper surfaces are contacted by the lower face of a circular contact washer on the solenoid plunger. To obtain proper contact between the washer and terminal surfaces, the terminal surfaces must be flat and oriented accurately in a plane radial of the plunger axis. However, this condition is seldom achieved in assembly of the terminals onto the housing because of the torque applied to the terminals in running the anchor nuts onto them.

Consequently, the upper terminal surfaces must be milled or otherwise machined in order to insure correct orientation. This step adds to the cost of manufacture. Moreover, during the milling operation and during the potting operation, chips of metal and particles of the potting material inevitably become deposited in the plunger opening. This necessitates a thorough cleaning of the opening which further adds to the cost of manufacture. The moisture-proofing intended by the potting material leaves something to be desired, particularly for marine applications.

The object of the present invention is to provide an improved method of switch manufacture which is quicker, simpler and less costly than known methods and which results in a product which can be sold to the consumer at a lower price than conventional switches and which has improved vibration resistance, moisture-proofing and accuracy of position of various components. One form of the invention is illustrated in the accompanying drawings.

FIG. 6 is a perspective view showing upper and lower dies parted after an injection molding step.

FIG. 7 is a perspective view illustrating ejection of the molded article from the lower die.

FIG. 8 is an enlarged scale, partly diagrammatic sectional view on line 8—8 of FIG. 6.

FIG. 9 is a top plan view of the switch with the cover removed.

FIG. 12 is a sectional view on line 12—12 of FIG. 10.

FIG. 13 is a sectional view on line 13—13 of FIG. 10.

FIG. 14 is a sectional view on line 14—14 of FIG. 13.

Figure 1:
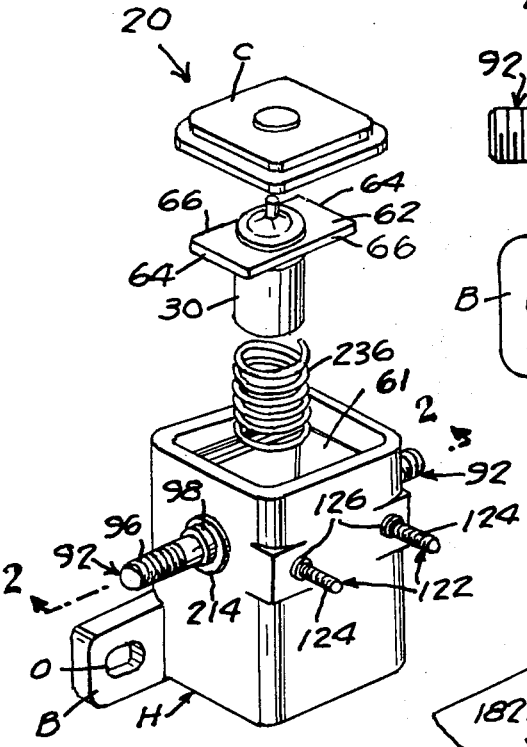
FIG. 1 is an exploded perspective view of a switch according to the present invention.

In the following disclosure such terms as upper, lower, vertical, etc. are used for the sake of convenience in describing various components and movements in the drawings as oriented and no structural limitations are implied thereby.

Shown in the drawings is a switch 20 according to the present invention. The switch comprises a solenoid unit 22 having a coil 24 wound on a bobbin 26 which defines a central opening 28 for receiving an axially movable magnetic plunger 30. Around coil 24 is a magnetic casing 32 formed of a side wall 34, an upper end wall 36 and a lower end wall 38. Wall 36 has a central opening 39 aligned with opening 28 through which plunger 30 extends. Wall 36 has an upper surface 40. Lower wall 38 has a plug or pin 42 staked thereto at 44 and having an upper surface 46 which forms the effective bottom of plunger opening 28. Lower wall 38 has a lower surface 47. Coil 24 has lead wires 46, 48 which extend from the interior of casing 32 through nipples 49 of insulating material to the exterior of the casing through notches 50, 52 in upper end wall 36, nipples 49 fitting within the notches. Side wall 34 has aligned pairs of upper notches 54 and lower notches 56 for intercommunicating the exterior of the casing and a radial space 57 between coil 24 and the interior of wall 34. These notches provide sprue ports or gates for a purpose described below.

Solenoid unit 22 is encapsulated within an injection molded plastic housing H having integral wings which cooperate to form a mounting bracket B provided with openings O for fasteners such as bolts. Housing H defines an internal chamber 61 within which plunger 30 moves, the chamber being closed by a cap C.

Figure 18:
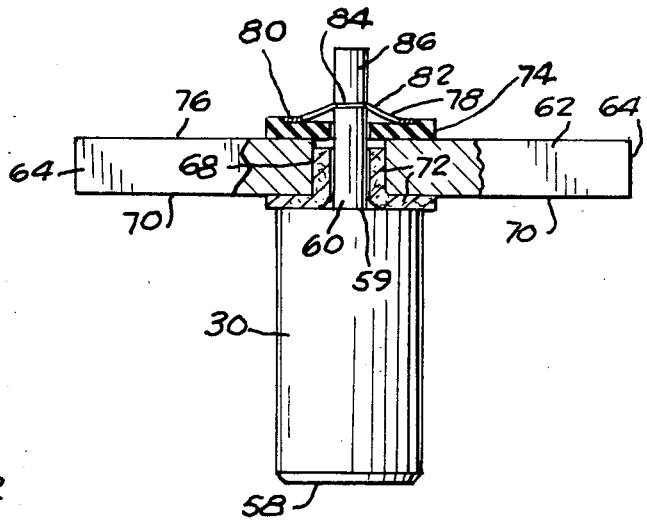
FIG. 18 is an elevational view of one form of plunger assembly.

In the form of switch shown in FIGS. 1 and 18, plunger 30 has a bottom surface 58 and an upper end portion 60 of reduced diameter forming a shoulder 59 and a pin or rod projecting axially therefrom. A non-circular contact member 62 is carried by the plunger. In the illustrated form of the invention, the contact member is rectangular (FIGS. 1 and 9) having a length which terminates in ends 64 and a width shorter than its length which terminates in sides 66. The contact member has a central opening 68 through which post 60 passes and has lower face portions 70 forming electrical contact surfaces. An L-shaped washer-ferrule 72 of insulating material is interposed between surfaces 59, 70 and between opening 68 and post 60. A washer 74 of elastomeric insulating material around post 60 is secured firmly against upper surface 76 of contact member 62 by a Tinnerman fastener 78 whose lower periphery 80 is engaged against washer 74 and whose upper periphery 82 is engaged in an annular notch 84 in rod 60. A portion 86 of the rod projects above notch 84 for a purpose to be described.

Figure 19:
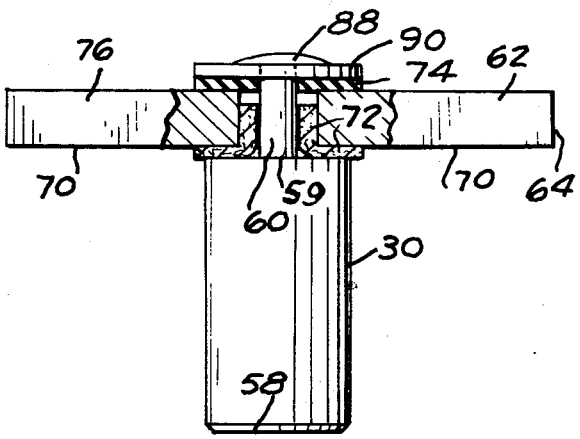
FIG. 19 is an elevational view of another form of plunger assembly.

The plunger assembly of FIG. 19 is similar to that of FIG. 18 except that rod 60 instead of having an upwardly projecting free end portion 86 is headed at 88 to provide a riveted connection between the plunger and contact member, and a washer 90 is interposed between head 88 and elastomeric washer 74.

Switch 20 includes in the illustrated form of the invention a pair of electric motor terminals 92 each having generally the form of a bolt with a head portion 94, a threaded shank portion 96 and an intermediate unthreaded shank portion 98. Each head 94 is provided with a flat surface 100 for electrical contact with the flat under surfaces 70 of contact member 62. Preferably, each head 94 has non-circular shape in three orthogonal planes as will be seen from a consideration of FIGS. 9, 10 and 11. Preferably, intermediate shank portion 98 has substantially circular sectional shape. Each terminal head 94 has a surface 102 which faces in the opposite direction from contact surface 100.

Head 94 has a thickness between surfaces 100, 102 which is held within a predetermined range of tolerances. Likewise, the axial thicknesses of end walls 36, 38 and the axial length of side wall 34 of solenoid housing 32 are held within predetermined tolerances. End walls 36, 38, side wall 34 and terminal heads 94 are in axially stacked relation in switch 20. Accumulations of high side tolerances of the stacked components, if left uncompensated, would result in an undesirable distance between bottom 46 of plunger opening 28 and contact surfaces 100 of terminal heads 94. To provide capability for such compensation axially compressible means are provided between bottom surface 47 and contact surfaces 100.

In the form of the invention illustrated the compressible compensating means comprises an axially compressible, fibrous, electrically insulating washer 104 interposed between solenoid unit 22 and terminal heads 94 so that one face 106 of the washer is engaged by upper surface 40 of upper wall 36, and the other face 108 of the washer is engaged by surfaces 102 on heads 94. Functioning and purpose of this arrangement is described in greater detail below. Washer 104 is provided with a pair of holes 110, 112 through which solenoid lead wires 46, 48 are threaded, is notched at diametrically opposite locations 113 to receive intermediate shank portions 98 of motor terminals 92, and has a central opening 115 for alignment with plunger opening 28.

Figure 16:
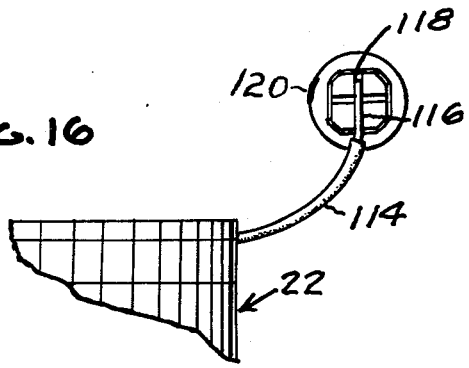
FIG. 16 is a fragmentary elevational view of the solenoid casing, a lead wire and contact post.
Figure 17:
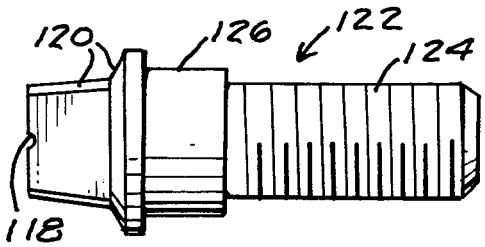
FIG. 17 is an enlarged scale side elevational view of a solenoid contact post.

Each lead wire 46, 48 extends exteriorly of solenoid casing 32 as represented at 114 in FIG. 16, and each wire has an end portion 116 which is welded, soldered or brazed within a notch 118 in a head portion 120 of a contact post 122 (FIG. 17). Each post 122 has generally the form of a bolt including a head 120, a threaded shank portion 124 and an intermediate unthreaded shank portion 126 which preferably has circular sectional shape. Preferably, head 120 has non-circular sectional shape in three orthogonal planes as is shown in FIGS. 16 and 17.

In accordance with the invention solenoid unit 22, head and shank portions of motor terminals 92 together with washer 104, head and shank portions of contact posts 122, and wire portions 114 are all firmly embedded and anchored in the common integral body of injection molded plastic material which forms housing H.

Figure 4:
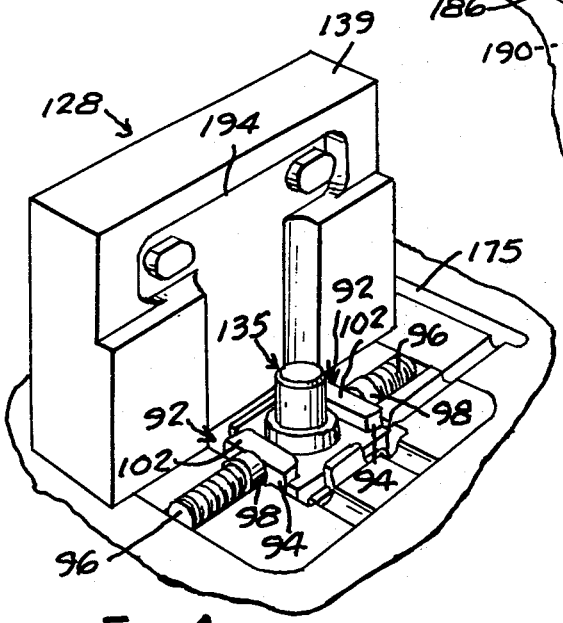
FIG. 4 is a fragmentary view similar to FIG. 3 showing electrical motor terminals positioned on the die.
Figure 5:
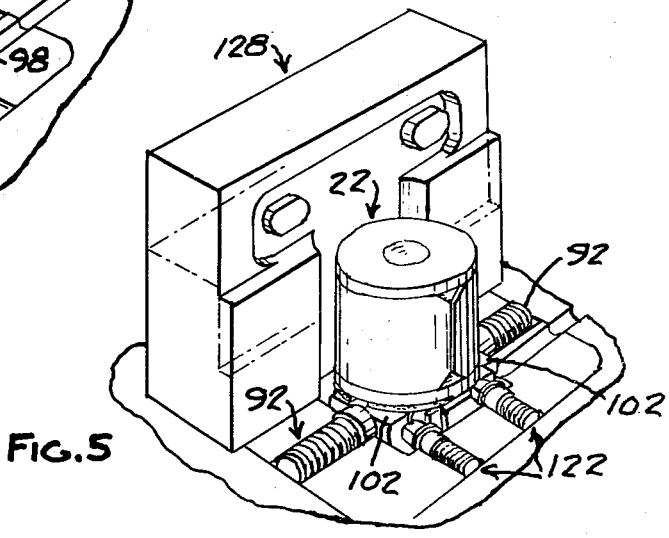
FIG. 5 is a view similar to FIG. 4 showing a solenoid unit and solenoid contact posts added to the die.
Figure 10:
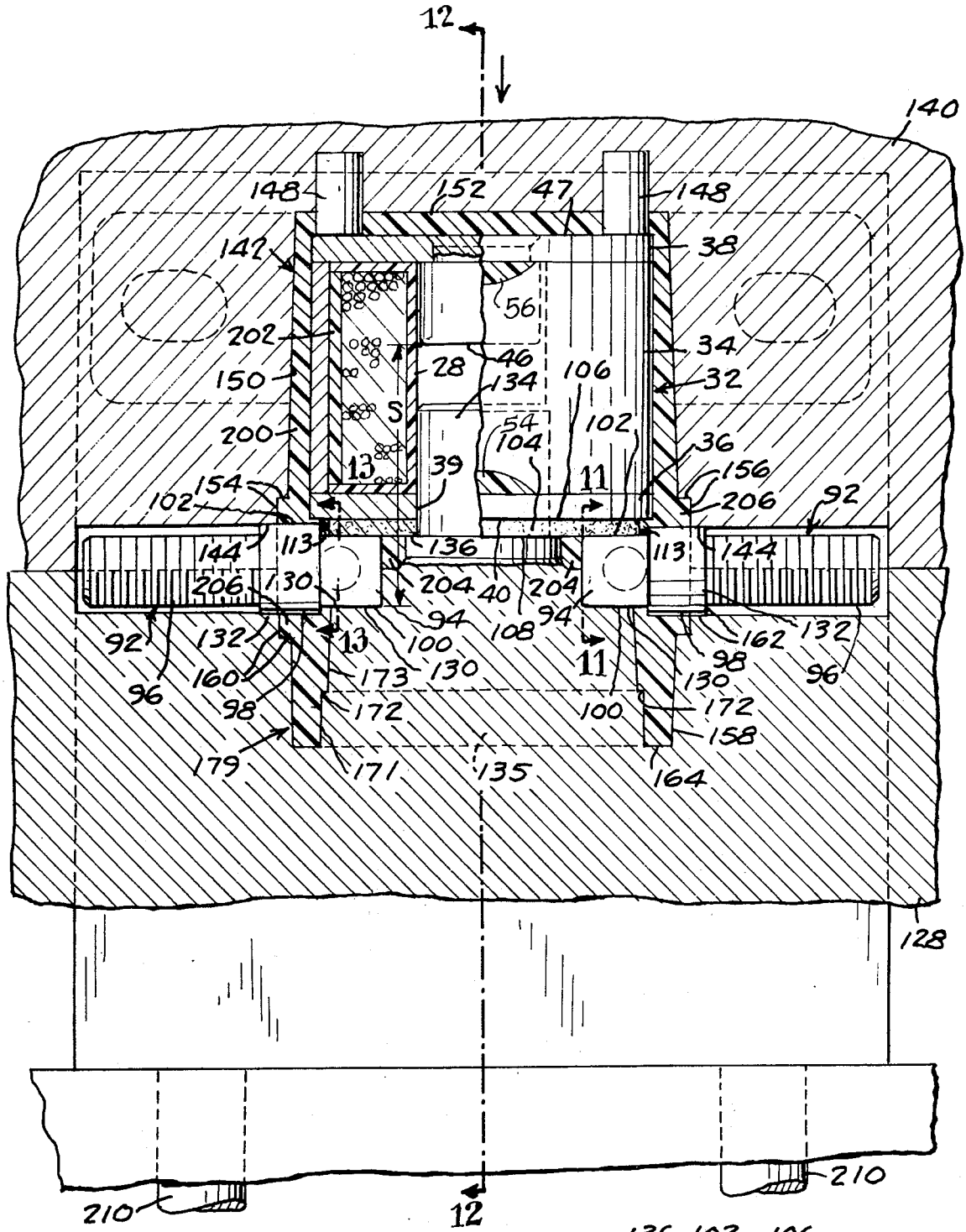
FIG. 10 is an enlarged scale fragmentary sectional view on line 10—10 of FIG. 6 but showing the dies in closed condition.
Figure 11:
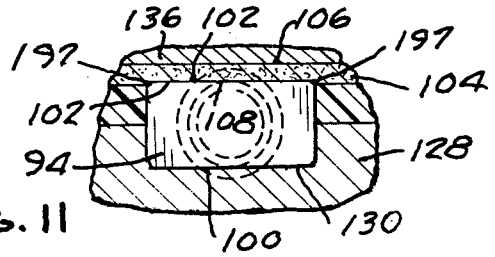
FIG. 11 is a sectional view on line 11—11 of FIG. 10.
Figure 15:
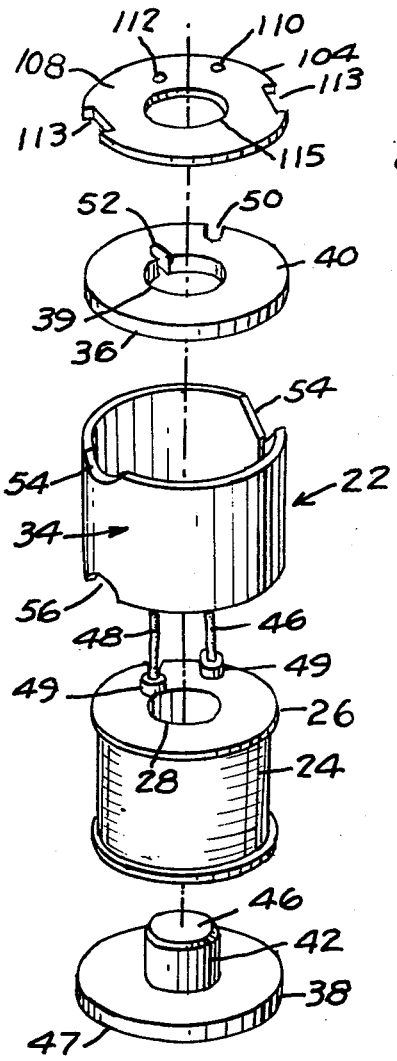
FIG. 15 is an exploded view showing the components of a solenoid unit.

To accomplish this motor terminals 92 are first positioned on the lower one 128 of a set of dies with contact surface 100 engaged against a die face 130 and with intermediate shank portion 98 engaged against a die face 132 (FIGS. 4, 10 and 11). Die face 130 fits accurately the flat configuration of contact surface 100 and die face 132 conforms accurately to the circular shape of intermediate shank portion 98. Next, after washer 104 has been assembled to solenoid casing 32 and lead wires 46, 48 have been soldered to contact posts 122, solenoid unit 22 is inverted and placed over lower die 128 (FIG. 5) with washer face 108 engaged against surfaces 102 of terminal heads 94 (FIGS. 10 and 11), with intermediate shank portion 98 disposed in washer notches 113 (FIG. 10) and with washer notches 50, 52 and washer holes 110, 112 (FIG. 15) circumferentially displaced from terminal heads 94.

During this step, a cylindrical portion 134 of a core 135 is inserted into plunger opening 28 through aligned openings 39 and 115 in end wall 36 of the solenoid unit and washer 104 respectively. An annular shoulder 136 at the base of core portion 134 is engaged against face 108 of washer 104 around opening 115. Also during this step, contact posts 122 are positioned in die cavities having die faces 138 (FIGS. 13 and 14) which conform accurately to the configuration of shank portion 126 of the contact posts.

Next, an ejection block 139 forming a part of lower die 128 is lowered and the upper one 140 of the set of dies is lowered over lower die 128. The upper die has a cavity 142 for receiving solenoid unit 22, a pair of die faces 144 (FIGS. 6 and 10) which conform accurately to the configuration of intermediate shank portion 98 of motor terminals 92, and a pair of die faces 146 (FIGS. 6, 13 and 14) which are configured to conform accurately to shank portions 126 of contact posts 122. Within die cavity 142 are a pair of thrust pins 148 positioned for engagement against surface 47 of end wall 38 of the solenoid unit.

As best shown in FIGS. 10 and 12, die cavity 142 has a generally axially extending face 150 which is spaced radially outwardly from and surrounds solenoid casing 32 and a radially extending face 152 spaced axially from surface 47 of end wall 38 of the casing. Pins 148 project from face 152 as shown. Surface 150 is stepped radially outwardly at 154 and 156 adjacent die faces 144. Lower die 128 has a face 158 which forms a continuation of face 150 and which is stepped radially outwardly at 160, 162 adjacent die faces 132. Face 158 terminates axially at a laterally extending face 164 from which core 135 projects axially toward the solenoid unit. Core 135 has a radially extending face 168 (FIG. 12) provided with a pair of small cavities 170 which extend continuously along face 168 adjacent its opposite sides. Core 135 has a surface 171 spaced inwardly of face 158 and stepped inwardly to form shoulders 172 which adjoin and lie in the same plane as the bottoms of cavities 170. From shoulders 172, core 135 continues upwardly in a generally axial face 173 which is tapered slightly inwardly and which terminates at die face 130. From there the core steps axially and radially inwardly to adjoin shoulder 136 (FIG. 10). Core 135 has generally axially extending faces 173*a* for a purpose to be described.

Figure 3:
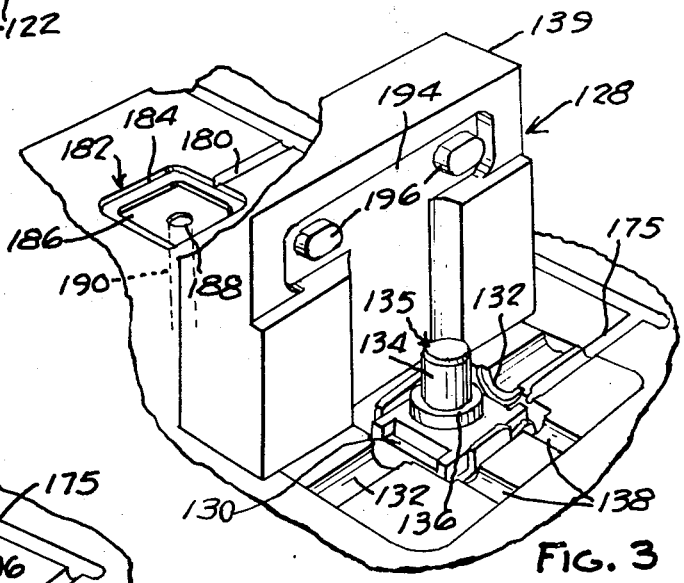
FIG. 3 is a perspective view of a lower injection molding die used in practice of the invention.

The upper and lower dies have cavities 174, 175 respectively which cooperate to form sprue runners and cavities 176, 178 which cooperate to form a gate for admitting fluent plastic into cavity 142 and the cavity 179 formed by core 135 and the surrounding faces of lower die 128. The dies also have cavities 180 (only the lower one being shown — FIGS. 3 and 6), forming a gate or branch sprue runner for admitting the plastic into a cavity 182 in lower die 128. This cavity has axially offset radially extending faces 184, 186, the latter of which has an axially extending circular recess 188. An ejector pin 190 underlies cavity 182. Ejector block 139 has a die cavity 194 which is a continuation of die cavity 142 and which is provided with cores 196.

When the dies are in closed condition, pins 148 exert thrust axially against end wall 38 of solenoid casing 32, and this thrust is transmitted through the casing and washer 104 to terminal heads 94 causing contact surfaces 100 to engage tightly against die faces 130. Also, face 108 of washer 104 is engaged forcibly against shoulder 136 on core 134. The washer has sufficient axial thickness so that even though the total combined axial tolerance of terminal heads 94 and solenoid casing 32 may be at their minumum, interengagement of washer face 108 and core shoulder 136 is tight enough to prevent plastic from penetrating therebetween into plunger opening 28 during the subsequent molding step.

Any additional accumulation of axial tolerance would tend to increase the distance S (FIG. 10) between bottom surface 46 of the plunger opening and die face 130. However, the thrust of pins 148 is sufficient to compress fibrous washer 104, as shown at 197 in FIG. 11, to the extent necessary to compensate for such additional accumulations of tolerance and insure that prior to the injection step bottom 46 is spaced axially from die face 130 by a distance only slightly greater than the axial distance between end surface 58 of plunger 30 and contact surfaces 70 of contact member 62. The result is that when solenoid 22 is energized, plunger 30 penetrates deeply into opening 28 for maximum magnetic attraction. On the other hand, however, distance S is great enough to prevent plunger bottom 58 from engaging bottom 46 of opening 28 which would interfere with engagement of contact surfaces 70 on the plunger with contact surfaces 100 on the terminals. By way of example, in a typical switch according to the invention, distance S is 0.952 inch and the distance between plunger end 58 and contact surfaces 70 is 0.930 inch. Thus when solenoid 22 is energized and contact surfaces 70, 100 are interengaged, plunger end 58 is spaced axially from bottom 46 of the plunger opening by a distance of 0.022 inch.

When the dies are closed, die faces 132, 144 forcibly engage around intermediate shank portions 98 of motor terminals 92, and die faces 138, 146 forcibly engage around shank portions 126 of contact posts 122. Die cavity 182 is closed by a face 198 on upper die 140.

Fluent plastic is now injected under pressure into sprue runners 174, 175, through gates 178, 180 and into die cavities 142 and 179 to form housing H, cavity 194 to form bracket B, and cavity 182 to form cap C. The plastic flows into the spaces between die face 150 and side wall 34 and between die face 152 and surface 47 of the solenoid unit to completely encapsulate those portions of the solenoid unit as at 200. The plastic also enters solenoid casing 32 through ports 54, 56 (FIG. 12) and into the radial space 57 between core 24 and side wall 34 to completely encapsulate the coil in plastic as at 202. The plastic also encapsulates portions of terminal heads 94 at 204 and portions of intermediate shanks 98 as at 206. The plastic completely embeds the heads 120 and portions of shanks 126 of contact posts 124 as at 208 (FIGS. 13 and 14) along with the portions 114 of lead wires 46, 48 which extend exteriorly of solenoid casing 32 to the contact posts as well as any exposed portions of the wires within the casing.

Die faces 130 and contact surfaces 100 of the motor terminals are mated so accurately and are interengaged so forcibly that the plastic material is substantially entirely excluded from penetration therebetween. Similarly, the surfaces of terminal shanks 98 and die faces 132, 144 are so accurately mated and are so forcibly interengaged that plastic is substantially entirely excluded from penetration therebetween. Similarly also, shanks 126 of contact posts 122 and die faces 138, 146 are so accurately mated and so forcibly interengaged that the plastic is substantially entirely precluded from penetrating therebetween.

To insure lack of penetration of the plastic around shanks 98, 126 past die faces 132, 144 and 138, 146, the dies grip the shanks with sufficient force to coin the metal of the shanks slightly. This is illustrated in somewhat exaggerated form in FIG. 8 wherein the uncoined diameter D of a shank 98 is shown in broken lines and the coined diameter D′ is shown in solid lines. Shanks 126 are coined in a similar manner. As will be seen from FIGS. 1 and 9, shanks 98 and 126 project exteriorly of housing H to provide lugs for the reception of washers against which electrical terminals can be clamped by nuts threaded onto the shanks.

After the plastic has set, upper die 140 is removed as in FIG. 6, and ejector mechanism is actuated to elevate ejector pin 190 for ejecting complete cap C from die cavity 182 and for elevating rods 210 which, in turn, raise ejector block 139 which by engagement with mounting bracket B carries the injection molded assembly 212 upwardly away from lower die 128 where it can be removed from the ejection block as represented by the arrows in FIG. 7.

The set plastic retains the accurate axial spacing between bottom 46 of plunger opening 28 and contact surfaces 100 of motor terminals 92. Precluding the plastic from penetration between the various die faces and surfaces of the motor terminals and contact posts engaged thereby has prevented the formation of flash over contact surfaces 100 of the motor terminals and at the exterior of the assembly around shank portions 98 and 126 of the motor terminals and contact posts respectively.

Contact surfaces 100 of the motor terminals are securely anchored flatly in a plane radial of plunger 30 for proper engagement by undersurfaces 70 of contact member 62. Stepped die faces 154, 156, 160, 162 and the taper of core face 173 has resulted in thickening of the plastic portions which surround intermediate shank portions 98 of the terminals and the formation of bosses 214 which reinforce the anchoring capability of the plastic. The anchoring capability of the plastic is further enhanced since the portions of the motor terminals and contact posts embedded therein are non-circular in three orthogonal planes so that it is very difficult to twist or turn the terminals or posts out of correct position.

The plastic material not only forms housing H for solenoid unit 22 but also defines chamber 61 within which the upper portion of plunger 30 and contact member 62 move. The chamber has side walls 216 and end walls 220. Each side wall has a radially thickened portion 222 (FIG. 9) with a small bead or ridge 224 thereon formed respectively by core face 168 and recess 170 (FIG. 12). Each end wall has a small shoulder or ridge 226 formed by core face 172 (FIGS. 10 and 12). Beads 224 integrally adjoin shoulders 226 to form a continuous surface extending in substantially the same plane around peripheral portions of the chamber and facing toward an open end 228 of the chamber. Within the chamber is a pair of walls 230 formed by faces **173*a* of core 135 (FIG. 12). These walls are generally parallel to and spaced radially outwardly of sides 66 of contact member 62. Bracket openings 0 are formed by cores 196**.

When upper die 140 is removed, pins 148 are withdrawn from bottom wall 232 of housing H leaving a pair of holes 234 which preferably are subsequently covered, plugged or filled to render the bottom wall moisture-proof. This can be done, for example, by filling the holes with a fluent plastic which will bond with the plastic of housing H and allowing the plastic to set.

In final assembly, plunger 30 is inserted through a coil spring 236 and is inserted through open end 228 of housing H so that plunger 30 enters opening 28 and contact member 62 is positioned between walls 230. Cap C is then inserted into opening 228 and its lower face 238 is engaged against beads 224 and shoulders 226. A moisture-proof connection is formed between face 238 and the beads and shoulders, preferably by fusing or welding the plastic thereof. This can be done by providing a coating of solvent type cement between the interengaged surfaces but preferably it is done by applying energy to the surfaces in the form of ultrasonic vibration and pressure which causes the surfaces to rub against each other, heat, soften and weld together. This can be accomplished by conventional ultrasonic welding equipment. When the welded plastic cools, cap C and housing H (holes 234 having been plugged as described) cooperate to render the interior of switch 20 substantially moisture-proof. This tends to reduce sparking between contact surfaces 70, 100 which in turn tends to reduce the possibility of explosion should the switch be used in a combustible-fume-laden atmosphere such as a motor boat bilge.

In the assembly procedure described in the preceding paragraph there is no necessity for machining contact surfaces 100 of terminals 92 since these surfaces are accurately positioned and oriented during the injection molding steps and there is no necessity for adding potting material to the solenoid since it has already been encapsulated during the molding step. Consequently, the usual source of contaminants for plunger opening 28 has been eliminated and the conventional step of thoroughly cleaning out the opening is unnecessary.

If flash were permitted to form on the exterior portions of terminals 92 and posts 122, it would have to be trimmed away to insure proper electrical contact between the terminals and posts and contacts engaged therewith. As is disclosed above, no such flash is permitted to form and no flash trimming step is necessary.

The plastic of housing H and cap C is preferably tough and relatively non-frangible, a suitable plastic being a polycarbonate. A suitable material for washer 104 is a high density fibrous material and a suitable material for filling holes 234 is an epoxy resin. Movements of dies 128,140, ejector pin 190 and ejector rods 210 are effected by suitable conventional equipment.

In use, terminals 92 are connected into the circuitry of an electric motor and contact posts 122 are connected to a source of electric current. When coil 24 is deactuated the parts of switch 20 are in the solid line position of FIG. 2 with plunger 30 retracted upwardly by spring 236 which is compressed between under surfaces 70 of contact member 62 and an exposed portion of washer face 108.

Figure 2:
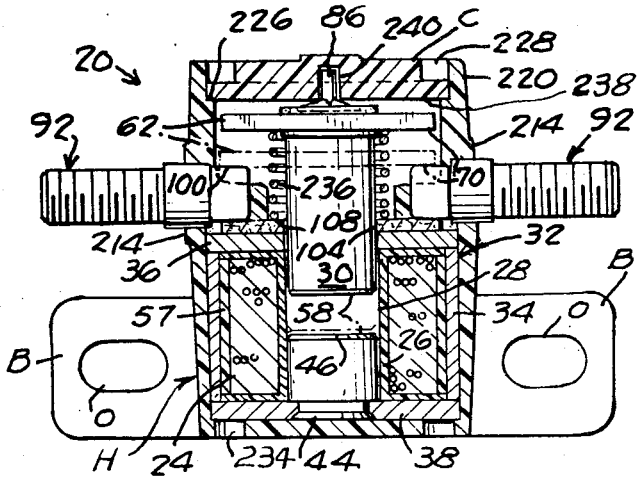
FIG. 2 is a longitudinal sectional view of the switch.

When coil 24 is actuated, plunger 30 is drawn downwardly to the dotted line position of FIG. 2 wherein under surfaces 70 of contact member 62 engage contact surfaces 100 of terminals 92 to close the electric motor circuit. End 58 of the plunger descends to a location closely adjacent bottom 46 of plunger opening 28 to provide an efficient magnetic circuit for interengaging contact surfaces 70,100 properly.

Nevertheless, end 58 is prevented from engaging bottom 46 which would prevent surfaces 70,100 from interengaging properly. This is because the lowermost position of end 58 is determined by the axial location of terminal surfaces 100 and the axial length of plunger 30 between surfaces 70 and end 58; and during the injection molding procedure bottom 46 was accurately positioned an axial distance from surfaces 100 slightly greater than the distance between surfaces 70 and 58. When coil 24 is deactuated, spring 236 returns the plunger and contact member to the upward solid line position of FIG. 2.

Conventional switches have a circular contact member with a diameter which approximates length 66 of contact member 62. Thus rectangular member 62 utilizes less material (usually copper or a copper alloy) and is commensurately cheaper and lighter weight.

During the course of use, plunger 30 tends to rotate about its axis, tending to carry contact surfaces 70 out of alignment with terminal surfaces 100. However, after only insignificant rotation, sides 66 or ends 64 of contact member 62 engage chamber walls 220 or 230, preventing further such rotation and maintaining surfaces 70 in proper alignment with surfaces 100.

In a switch 20 having the form of plunger shown in FIG. 18, pin 86 projects axially into a guide opening 240 molded into the under side of cap C (FIG. 2) by a core pin (not shown) projecting downward from upper die surface 198 into die cavity 182. Interengagement of the pin and opening cooperate with chamber walls 220,230 to guide movements of contact member 62 and therefore of plunger 30. In a switch having the FIG. 19 form of plunger which has no pin 86, walls 220,230 alone guide movements of the contact member and plunger except for a small amount of lateral stability provided by spring 236. In commercial practice of the invention I believe that the FIG. 19 plunger assembly will be preferable since it is the more economical to manufacture and since on the basis of my experience to date it appears that the additional guidance of pin 86 and opening 240 may be unnecessary.

Encapsulation in the plastic of coil 24, solenoid unit 22 as a whole, wires 46,48, and portions of motor terminals 92 and contact posts 122 anchor these parts against vibration relative to each and therefore renders injection molded assembly 212 virtually immune to the effects of vibration of, for example, an internal combustion engine. Since plunger 30, contact member 62, and spring 236 are not usually susceptible to damage from such vibration, switch 20 as a whole is largely vibration proof.

I claim:

1. In the manufacture of a switch having a plastic housing which contains a contact member movable to and from electrical contact with a surface of a terminal within the housing, the method of making the housing and terminal assembly which comprises, providing a set of dies cooperable in closed condition to define the configurations of the housing, one of said dies having a face which conforms accurately to the contour of said terminal surface, with said dies in open condition, positioning said terminal so that said surface is positioned for engagement against said face, effecting relative closing movement of said dies and thereby causing said surface and face to advance toward each other in substantially the direction of relative movement of such contact member and surface for making electrical contact, exerting force to cause said surface and face to interengage tightly, injecting fluent plastic under pressure into the closed dies for forming said housing and causing portions of said plastic to encapsulate portions of said terminal, during said injecting step utilizing said die face for accurately positioning said terminal surface in said direction relative to said housing, said force and accuracy of contour being sufficient so that during said injecting step they are utilized to exclude said plastic substantially entirely from penetration between said surface and face, then after said plastic has set, opening said dies and removing the assembly of said formed housing and encapsulated terminal.

2. The method defined in claim 1 wherein said terminal surface and die face are substantially flat.

3. The method defined in claim 2 wherein said terminal has a head and a shank, said surface being provided on said head and said encapsulated portions comprising portions of said shank and head.

4. The method defined in claim 3 wherein said shank has a portion adjacent said encapsulated portion, said dies having additional faces which conform accurately to the contour of said adjacent portion, when said dies are closed, exerting force to cause said additional faces and adjacent portion to interengage tightly, the latter said force and accuracy of contour being sufficient so that during said injecting step they are utilized to exclude said plastic substantially entirely from penetration between said additional faces and adjacent portion.

5. The method defined in claim 1 wherein there are a plurality of said terminals, said one die having a corresponding plurality of said faces.

6. The method defined in claim 5 wherein there are two of said terminals and two of said die faces, said die faces being so positioned that when said terminal surfaces are engaged therewith, said terminals are disposed adjacent opposite sides of the housing to be formed.

7. A method defined in claim 5 wherein each of said terminals has a shank extending on an axis and a head, said head having a portion of non-circular cross section in a plane perpendicular to said axis, said surface being provided on said head, said encapsulated portions of each terminal comprising a portion of said shank and said non-circular portion of said head.

8. The method defined in claim 5 wherein said dies have other faces against which plastic is injected in said injecting step, said other faces cooperating to form an integral mounting bracket on said housing.

9. In the manufacture of a switch having a plastic housing which contains a contact member movable to and from electrical contact with a surface of a terminal within the housing, the method of making the housing and terminal assembly which comprises, providing a set of dies cooperable in closed condition to define the configurations of the housing, one of said dies having a face which conforms accurately to the contour of said terminal surface, with said dies in open condition, positioning said terminal so that said surface is positioned for engagement against said face, closing said dies and exerting force to cause said surface and face to interengage tightly, injecting fluent plastic under pressure into the closed dies for forming said housing and causing portions of said plastic to encapsulate portions of said terminal, during said injecting step utilizing said die face for accurately positioning said terminal surface relative to said housing, said force and accuracy of contour being sufficient so that during said injecting step they are utilized to exclude said plastic substantially entirely from penetration between said surface and face, then after said plastic has set, opening said dies and removing the assembly of said formed housing and encapsulated terminal, said terminal having a head and a shank, said surface being provided on said head and said encapsulated portions comprising portions of said shank and head, said shank having a portion adjacent said encapsulated portion, said dies having additional faces which conform accurately to the contour of said adjacent portion, when said dies are closed exerting force to cause said additional faces and adjacent portion to interengage tightly, the latter said force and accuracy of contour being sufficient so that during said injecting step they are utilized to exclude said plastic substantially entirely from penetration between said additional faces and adjacent portion, the latter said force being sufficient to cause said additional faces to coin at least slightly the material of said adjacent portion.

10. In the manufacture of a switch having a plastic housing which contains a contact member movable to and from electrical contact with a surface of a terminal within the housing, the method of making the housing and terminal assembly which comprises, providing a set of dies cooperable in closed condition to define the configurations of the housing, one of said dies having a face which conforms accurately to the contour of said terminal surface, with said dies in open condition, positioning said terminal so that said surface is positioned for engagement against said face, closing said dies and exerting force to cause said surface and face to interengage tightly, injecting fluent plastic under pressure into the closed dies for forming said housing and causing portions of said plastic to encapsulate portions of said terminal, during said injecting step utilizing said die face for accurately positioning said terminal surface relative to said housing, said force and accuracy of contour being sufficient so that during said injecting step they are utilized to exclude said plastic substantially entirely from penetration between said surface and face, then after said plastic has set, opening said dies and removing the assembly of said formed housing and encapsulated terminal, there being a plurality of said terminals, said one die having a corresponding plurality of said faces, said terminals being provided with other surfaces which face oppositely from the first mentioned surfaces, and including the following additional steps:

after said terminals have been so positioned and while said dies are in said open condition, positioning a solenoid unit for engagement with said other surfaces, when said dies are closed, exerting force to cause said unit to engage tightly against said other surfaces, and during said injecting step, causing said plastic to encapsulate said unit so that it forms a portion of said assembly.

11. The method defined in claim 10 and including the steps of forming said solenoid unit by providing a coil, providing a ported casing around said coil, leaving radial space between the turns of said coil and said casing, and utilizing the porting in said casing as sprue means in said injecting step to admit said plastic into said space for encapsulating said coil in said plastic.

12. The method defined in claim 11 wherein said porting comprises a plurality of radial ports in said casing.

13. The method defined in claim 12 wherein said ports are arranged in one pair of diametrically opposite ports adjacent one end of said casing and another pair of diametrically opposite ports adjacent the other end of said casing.

14. The method defined in claim 13 wherein the ports of each pair are generally axially aligned with the ports of the other pair.

15. The method defined in claim 10 wherein said solenoid unit includes a coil with electric leads connected to terminal posts, said dies being provided with additional faces which conform accurately to the contour of portions of said posts, when said dies are in said open condition, positioning said posts for engagement with said additional faces, when said dies are closed, exerting force to cause said additional die faces and post portions to interengage tightly, during said injection step, causing said plastic to encapsulate other portions of said posts.

16. The method defined in claim 15 wherein the latter said force and accuracy of contour are sufficient so that during said injecting step they are utilized to exclude said plastic substantially entirely from penetration between said additional faces and post portions.

17. The method defined in claim 16 wherein the latter said force is sufficient to cause said additional faces to coin at least slightly the material of said post portions.

18. The method defined in claim 11 wherein said coil has lead wires, portions of which are within said casing and portions of which are exterior of said casing, said exterior portions being connected to terminal posts, in said injecting step causing portions of said plastic to encapsulate portions of said posts, said exterior portions of said wires and portions of said wires within said casing.

19. In the manufacture of a switch having a plastic housing which contains a solenoid unit comprised of a coil having an opening for a magnetic plunger and a casing around the coil having a side wall and end walls, one of which is apertured in alignment with said opening and the other of which has means defining the bottom of said opening, said housing containing a plurality of terminals having surfaces positioned for engagement by surface portions of a contact member on the plunger, said plunger having an end face located at a known distance from said surface portions, the method of making the housing, solenoid unit and terminal assembly which comprises, providing said unit with a length axial of said coil within a predetermined range of axial tolerance, providing the portions of said terminals which define said surfaces with a thickness axial of said coil which is within a predetermined range of axial tolerance, each said terminal portion having a second surface spaced from the first mentioned surface by said thickness, providing a set of dies cooperable in closed condition to define the configurations of the housing, one of said dies having faces and another of said dies having thrust means, with said dies in open condition, positioning each terminal so that its first surface is positioned for engagement against a said die face and positioning said unit in axial alignment with said second surfaces, providing axially compressible means axially between said first terminal surfaces and said other end of said casing, closing said dies and causing said thrust means to exert axial force on said casing in a direction toward said die face, said force being sufficient to cause said compressible means to compress axially to the extent necessary to compensate for cumulative tolerances of said unit and terminal portions to enable said bottom of said plunger opening to become positioned axially from said first terminal surfaces by a distance only slightly greater than said known distance, while said bottom is so positioned, injecting fluent plastic under pressure into the closed dies for forming said housing and causing portions of said plastic to encapsulate said unit and portions of said terminals, after said plastic has set, opening said dies and removing said assembly therefrom and utilizing the set plastic to maintain said relative axial spacing between said bottom and first terminal surfaces.

20. The method defined in claim 19 wherein said compressible means is disposed between said second terminal surfaces and said one end wall.

21. The method defined in claim 20 wherein said compressible means comprises fibrous material.

22. The method defined in claim 21 wherein said fibrous material is engaged at one side by said second terminal surfaces and at the other side by said one end of said casing.

23. The method defined in claim 22 wherein said fibrous material is washer-shaped having a central opening aligned with said plunger opening.

24. The method defined in claim 23 wherein prior to positioning said unit in axial alignment with said second surfaces, said washer is assembled to said unit.

25. The method defined in claim 24 wherein in assembling said washer to said unit lead wires from said coil are passed through other openings in portions of said washer circumferentially displaced from the location of said second terminal surfaces.

26. The method defined in claim 19 wherein said force is exerted on said other end of said casing.

27. The method defined in claim 26 wherein said thrust means comprises means projecting from a wall of said other die for axial engagement against said other end, portions of said plastic during said injecting step flowing between said wall and said other end and surrounding said projecting means.

28. The method defined in claim 27 wherein said projecting means comprises a plurality of spaced apart pins.

29. The method defined in claim 27 and including in addition the step after said plastic has set of filling the opening in said housing left by said projecting means with a plastic material bondable with said plastic so that the portions of said housing overlying said end wall are substantially moisture-proof.

30. The method defined in claim 20 wherein said faces conform accurately to the contour of said first surfaces, said force and accuracy of contour being cooperable in said injecting step to exclude said plastic substantially entirely from penetration between said faces and first surfaces.

31. The method defined in claim 30 wherein each of said terminals has a shank and a head, said surfaces being formed on said head, said dies having radially outwardly of each of said faces a set of complemental faces which conform accurately to the contour of portions of said shanks which are radially outward of said heads when said first surfaces are engaged with the first mentioned die faces, each set of complemental faces being engaged tightly around a said shank portion when said dies are in closed condition, said force and the latter said contour accuracy being cooperable in said injecting step to exclude said plastic substantially entirely from penetration between said shank portions and complemental die faces.

32. The method defined in claim 31 wherein space is provided between the turns of said coil and interior surface portions of said casing, said casing being ported between said space and casing exterior, and utilizing the porting in said casing as sprue means in said injecting step to admit portions of said plastic into said space for encapsulating said coil in said plastic.

33. The method defined in claim 32 wherein said coil has lead wires extending from within said casing to the exterior thereof, the exterior portions of said wires being connected with terminal posts, said dies having for each post an additional set of complemental faces which conform accurately to the contour of portions of said posts, with said dies in open condition, positioning said post portions for engagement by said additional complemental die faces, each set of said additional complemental faces being engaged tightly around a said post portion when said dies are in closed condition, in said injecting step, causing portions of said plastic to encapsulate the portions of said wires both within and without said casing and to encapsulate portions of said posts adjacent the portions engaged by said additional complemental die faces, said force and the last said contour accuracy being cooperable in said injecting step to exclude said plastic substantially entirely from penetration between said post portions and additional complemental die faces engaged therewith.

34. The method defined in claim 33 wherein each post has a shank portion and a head portion comprising respectively the first mentioned post portions and said adjacent post portions, each said post head portion having non-circular sectional shape.

35. The method defined in claim 20 wherein space is provided between the turns of said coil and interior surface portions of said casing, said casing being ported between said space and causing exterior, and utilizing the porting in said casing as sprue means in said injecting step to admit portions of said plastic into said space for encapsulating said coil in said plastic.

36. The method defined in claim 35 wherein said coil has lead wires, portions of which are within said casing and portions of which are exterior of said casing, said exterior portions being connected to terminal posts, in said injecting step causing portions of said plastic to encapsulate portions of said posts and said exterior portions of said wires, and utilizing the porting in said casing as sprue means to admit portions of said plastic into said space for encapsulating said coil and portions of said wires within said casing.

37. In the manufacture of a switch having a plastic housing which contains a contact member movable to and from electrical contact with a surface of a terminal within the housing, the method of making the housing and terminal assembly which comprises, providing a set of dies cooperable in closed condition to define the configuration of the housing, one of said dies having a face which conforms accurately to the contour of said terminal surface, with said dies in open condition, positioning said terminal so that said surface is positioned for engagement against said face, closing said dies and exerting force to cause said surface and face to interengage tightly, injecting fluent plastic under pressure into the closed dies for forming said housing and causing portions of said plastic to encapsulate portions of said terminal, during said injecting step utilizing said die face for accurately positioning said terminal surface relative to said housing, said force and accuracy of contour being sufficient so that during said injecting step they are utilized tp exclude said plastic substantially entirely from penetration between said surface and face, then after said plastic has set, opening said dies and removing the assembly of said formed housing and encapsulated terminal, there being a plurality of said terminals, said one die having a corresponding plurality of said faces, said dies being configurated to define a housing which has an open end, when said dies are in said open condition, positioning a solenoid unit for containment therein, in said closing step, causing said dies to enclose said unit, in said injecting step, causing portions of said plastic to encapsulate said unit, inserting into said open end of said formed housing a magnetic plunger and contact member, providing a cap having surfaces which mate with surfaces of said housing adjacent said open end, interengaging said cap and housing surfaces and forming a substantially moisture-proof connection therebetween.

38. The method defined in claim 37 wherein said cap surfaces are plastic, said connection being formed by applying means to said surfaces creating a welded plastic connection therebetween.

39. The method defined in claim 38 wherein said means comprises a plastic cement applied between said surfaces.

40. The method defined in claim 38 wherein said means comprises energy applied to heat said interengaged surfaces to cause the plastic thereof to fuse together.

41. The method defined in claim 40 wherein said energy comprises ultrasonic vibration of said surfaces relative to each other.

42. The method defined in claim 37 wherein said housing, cap and surfaces thereof are formed of the same plastic material, forming on one of said surfaces a bead which projects toward the other surface, pressing said other surface and bead against each other and causing said bead and other surface to vibrate ultrasonically relative to each other, said pressing and the energy of said vibration being adequate to heat said bead and the portions of said other surface engaged thereby to softened condition, and to cause the softened plastic to weld together.

43. The method defined in claim 42 wherein said housing surfaces and bead comprise configuration defined by said dies in said closed condition, and forming said housing surfaces and bead during said injecting step.

44. The method defined in claim 43 wherein said housing surfaces and bead are disposed within the confines of said housing and face said open end, said other surfaces being formed on said cap, and inserting portions of said cap into said open end so to interengage said bead and other surface.

45. The method defined in claim 42 wherein said dies have faces which in said closed condition define the configurations of said one surface, bead, other surface and said cap within which plastic is injected to form the same during said injecting step.

* * * * *

UNITED STATES PATENT OFFICE

CERTIFICATE OF CORRECTION

PATENT NO. : 4,112,576

DATED : September 12, 1978

INVENTOR(S) : Harry Robert Gross

It is certified that error appears in the above-identified patent and that said Letters Patent are hereby corrected as shown below:

Column 13, line 44, delete "20" and insert --19--.
Column 14, line 34, delete "20" and insert --19--.
Column 14, line 37, delete "causing" and insert --casing--.
Column 15, line 7, delete "tp" and insert --to--.
Column 16, line 22, delete "configuration" and insert --configurations--.
Column 16, line 30, after "so" insert --as--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*